United States Patent [19]

Baggio et al.

[11] Patent Number: 4,928,408

[45] Date of Patent: May 29, 1990

[54] SKI BOOT WITH IMPROVED WEARABILITY

[75] Inventors: Giorgio Baggio, San Martino Du Lupari; Mario Gonella, Conegliano; Mariano Sartor, Montebelluna, all of Italy

[73] Assignee: NORDICA S.P.A., Montebelluna, Italy

[21] Appl. No.: 240,908

[22] Filed: Sep. 7, 1988

[30] Foreign Application Priority Data

Sep. 17, 1987 [IT] Italy ..... 82587 A/87
Oct. 16, 1987 [IT] Italy ..... 82595 A/87

[51] Int. Cl.[5] ..... A43B 5/04
[52] U.S. Cl. ..... 36/119; 36/117
[58] Field of Search ..... 36/117–121, 36/105, 115, 50

[56] References Cited

U.S. PATENT DOCUMENTS

| | | | |
|---|---|---|---|
| 3,609,887 | 10/1971 | Hickmann et al. | 36/121 X |
| 4,422,248 | 12/1983 | Bataille et al. | 36/121 |
| 4,551,933 | 11/1985 | Morell et al. | 36/120 |
| 4,565,017 | 1/1986 | Ottieri | 36/117 |
| 4,615,127 | 10/1986 | Delery | 36/117 |
| 4,719,709 | 1/1988 | Vaccari | 36/117 |

FOREIGN PATENT DOCUMENTS

| | | | |
|---|---|---|---|
| 2749887 | 8/1978 | Fed. Rep. of Germany | 36/115 |
| 3721620 | 1/1988 | Fed. Rep. of Germany | 36/119 |
| WO85/04557 | 10/1985 | PCT Int'l Appl. | 36/117 |

*Primary Examiner*—Paul T. Sewell
*Assistant Examiner*—Andrew D. Meyers
*Attorney, Agent, or Firm*—Guido Modiano; Albert Josif

[57] ABSTRACT

Ski boot having a shell, a rear quarter and a front quarter, at least the rear quarter being pivoted to the shell. The rear quarter is also articulated to an element of the boot, such as the front quarter, the shell or a flap by means of rods.

37 Claims, 4 Drawing Sheets

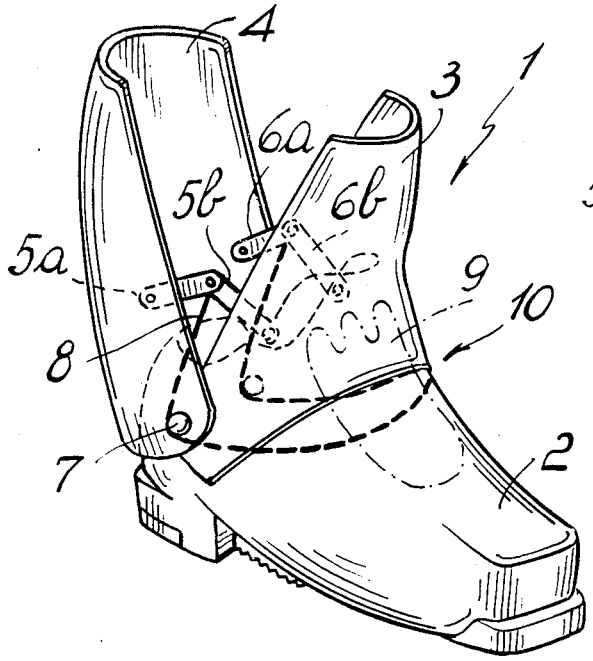
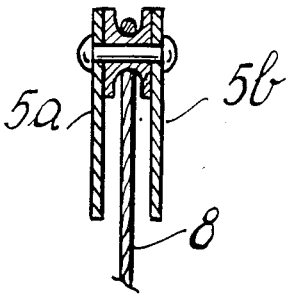
Fig. 2
Fig. 1
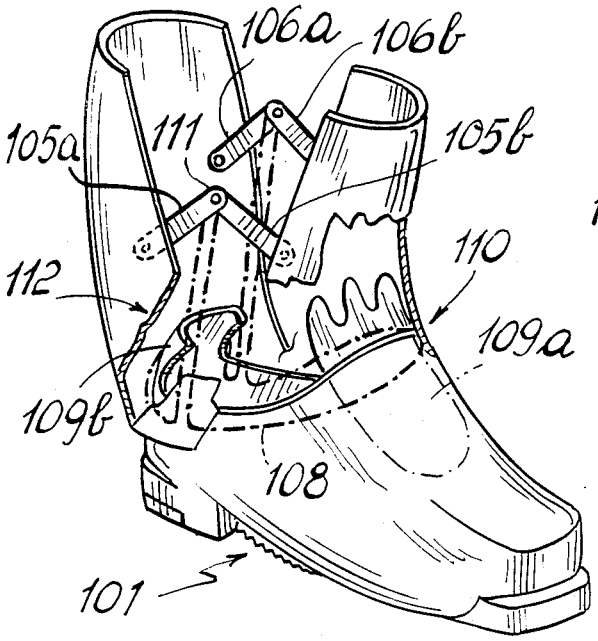
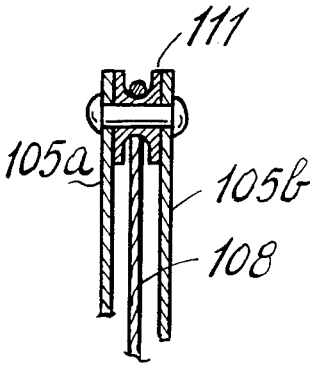
Fig. 4
Fig. 3

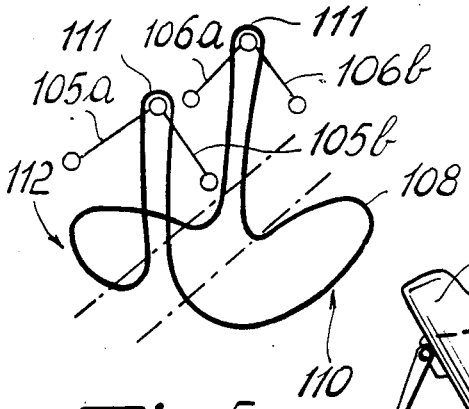
Fig. 5
Fig. 6
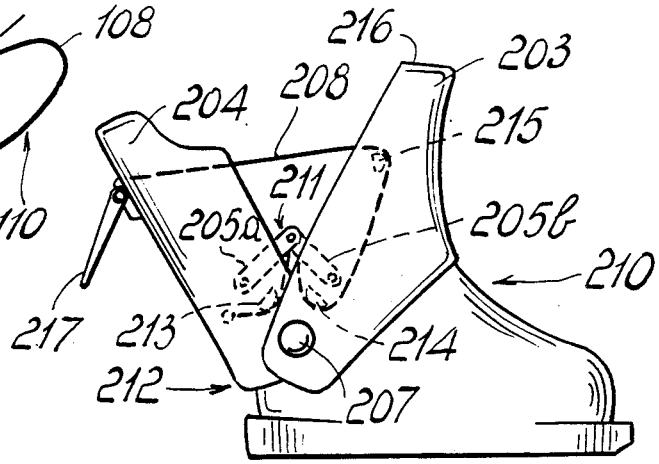
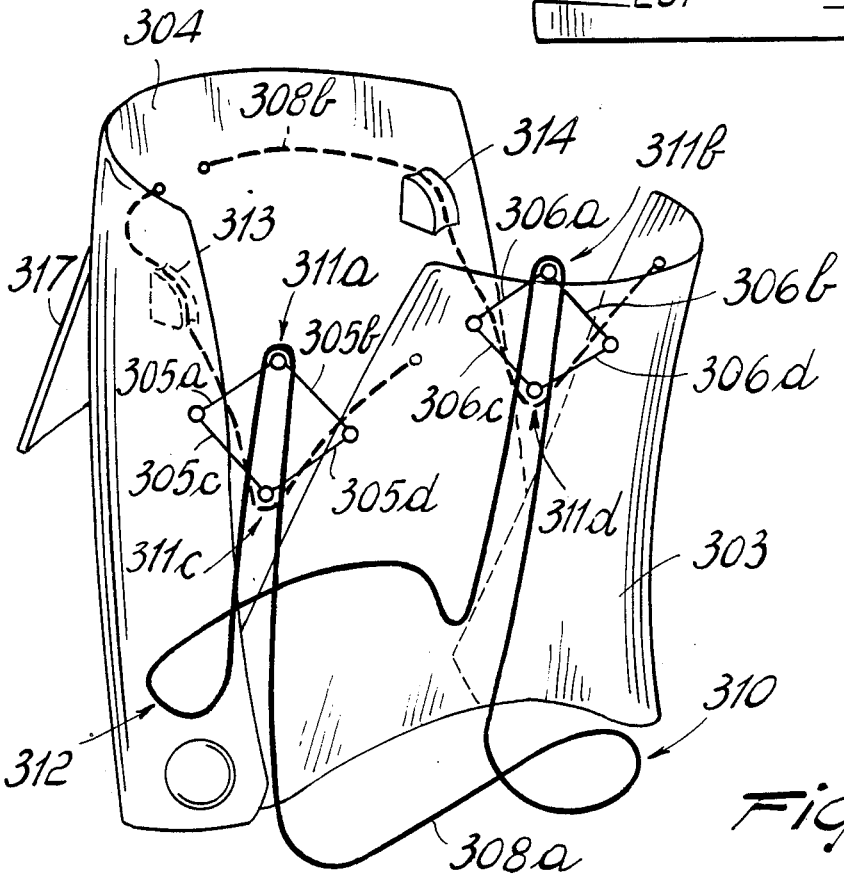
Fig. 7

SKI BOOT WITH IMPROVED WEARABILITY

BACKGROUND OF THE INVENTION

The present invention relates to a ski boot with improved wearability.

Numerous devices are currently known which, applied to ski boots, allow the securing of the quarters and/or of the foot using traction elements such as cables.

Mention is made, by way of example, of the system disclosed in the French patent application publication No. 2345097, wherein the rear quarter is connected by means of a band or a cable to a foot instep presser.

Mention is furthermore made of the published German patent application Ser. No. 2317408, which discloses a complicated system for connecting the rear quarter and the foot presser by means of a cable guided by pulleys.

Regarding the securing of the quarters, the problem of having to recover a substantial portion of the cable in order to allow the successive stroke for the complete opening of the rear quarter is particularly felt.

In known devices the takeup is usually performed manually by the skier by acting on knobs which actuate winders or by means of automatic takeup devices.

In the first case, besides a long time required to complete the winding operation, disadvantages due to scarce practicality in operation are also observed.

In the second case these known devices are rather complicated and bulky, their cost being high.

This bulk furthermore spoils the aesthetical line of the boot and increases its weight, these being all negative factors for the skier.

Ski boots are furthermore known having inside a flap which can be rigidly associated with the shell or with an inner shoe arrangeable internally to said boot.

A disadvantage observed in these known types of boot resides in the fact that, with the quarters open, the flap may arrange itself inclined with respect to the axis perpendicular to the resting plane of the boot, with its free end orientated so as to partially occlude the opening for the insertion of the foot in the shell.

This arrangement therefore does not allow the easy insertion of the foot and can force the skier to intervene manually to move the flap backwards.

As a partial solution to this disadvantage it is necessary to provide a rear quarter which has a wider opening stroke to allow a better insertion of the foot and an easier intervention on the flap.

The disadvantage which consequently arises resides in that it is necessary to use quarter closure devices adapted to takeup a considerable amount of cable, forcing the skier to a prolonged adjustment operation, the devices being bulky and unaesthetical.

Furthermore, during the closure of the quarters there occurs a sliding between the outer surface of the flap and the inner surface of the rear quarter: the friction between them can complicate the closure of the quarters on the part of the skier, as he may have to exert a greater effort for their mutual approach.

SUMMARY OF THE INVENTION

The aim of the present invention is to eliminate the disadvantages described above in known types by providing a system for securing the quarters and/or the foot in a ski boot having a reduced bulk which allows to maintain the aesthetical lines of the boot as neat as possible.

Within the scope of this aim, an object of the invention is to provide a boot having an inner flap wherein the insertion of the foot is always easy, maintaining a limited opening stroke of the quarters.

Another important object is to provide a boot wherein the presence of the rear flap does not constitute a hindrance in closing the quarters.

Still another object is to provide a boot which associates with the preceding characteristics that of optimally securing the heel of the skier's foot in its interior.

Not least object is to provide a boot which associates with the preceding characteristic that of allowing an easy release of the heel upon the opening of the quarters.

Another important object is to provide a boot which is extremely simple from a manufacturing point of view.

Yet another object is to provide a boot which has considerable simplicity in use combined with high reliability.

Not least object is to provide a boot which associates with the preceding characteristics that of having at the same time modest costs.

The intended aim and objects are achieved by a ski boot comprising a shell, a rear quarter and a front quarter, at least said rear quarter being pivoted to said shell, characterized in that said rear quarter is furthermore articulated to an element of said boot by means of rigid articulation means.

BRIEF DESCRIPTION OF THE DRAWINGS

Further characteristics and advantages of the invention will become apparent from the detailed description of a particular embodiment, illustrated only by way of nonlimitative example in the accompanying drawings, wherein:

FIG. 1 is a partially sectioned perspective view of a boot according to the invention;

FIG. 2 is a cross section view taken at the articulation between two rod-like elements of the boot of FIG. 1;

FIG. 3 is a view, similar to FIG. 1, of a boot according to another aspect of the invention;

FIG. 4 is a view, similar to FIG. 2, related to the boot illustrated in FIG. 3;

FIG. 5 is a schematic perspective view of the interaction between the traction element and the pairs of rod-like elements, related to the boot of FIG. 3;

FIG. 6 is a lateral elevation view of a boot according to a third aspect of the invention;

FIG. 7 is a perspective view of a boot according to a fourth aspect;

DESCRIPTION OF THE PREFERRED EMBODIMENTS

Figure 8:
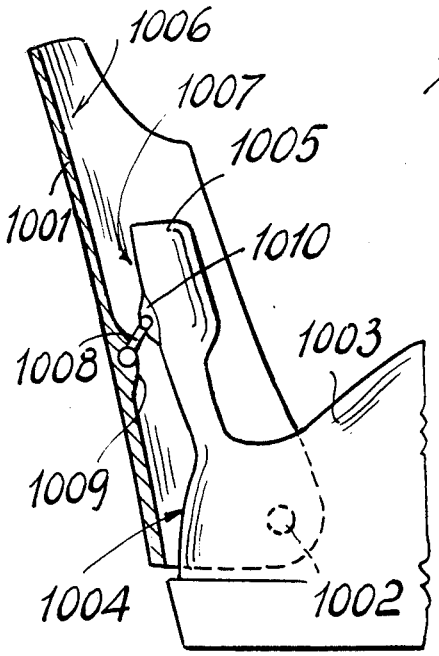
FIG. 8 is a partially sectioned and cutout lateral elevation view of a boot according to a fifth embodiment.

With reference to FIGS. 1 and 2, a ski boot, generally indicated by the reference numeral 1, comprises a front quarter 3 and a rear quarter 4 associated to a shell.

The rear quarter 4 is pivoted to the shell 2 and is articulated to the front quarter 3 by means of two pairs of rods, indicated by the reference numerals 5*a*, 5*b* and 6*a*, 6*b*.

The rods 5*a*, 5*b* and 6*a*, 6*b* are articulated to one another in pairs at one end, and are articulated at the other end respectively to the rear quarter 4 and to the front quarter 3 above their pivoting stud 7.

Said rods are articulated at the related inner surfaces of said front quarter and rear quarter or at the outer surface of the shell.

At the point of articulation between each of said two pairs or rods there is associated therewith the end of a traction element constituted by a cable 8 guided to affect a presser 9 arranged at the region 10 of the skier's foot instep.

The presser can be alternatively constituted by a flap associated with the shell or with the inner shoe at the heel region, the cable acting in said region.

The operation of the device is as follows: as the rear quarter 4 approaches the front quarter 3, correspondingly the articulation points of the rods 5*a* and 6*a* approach the articulation points of the rods 5*b* and 6*b*.

This produces a lifting of the points of articulation between the pairs of rods 5*a*, 5*b* and 6*a*, 6*b* which stretches the cable 8, and said cable in turn secures the region 10 of the foot instep by exerting a pressure on the presser 9; the action can be alternatively exerted on the heel.

FIG. 3 illustrates a boot 101 wherein at the points of articulation between each of the pairs of rods 105*a*, 105*b* and 106*a*, 106*b* there is rotatably interposed a pulley 111 at which the cable 108 is guided and is thus free to slide.

Said cable is thus guided to affect a presser 109*a* arranged at the foot instep region 110 and a presser 109*b* arranged at the foot heel region 112.

The simultaneous securing of the two regions 110 and 112 is thus achieved without forcing the skier to actuate means for taking up the cable.

FIG. 6 illustrates a further embodiment of the boot according to the invention, wherein a single cable 208 is again used and affects both pulleys 211 interposed between the mutually articulated ends of the two pairs of rods.

Only the rods 205*a* and 205*b* have been indicated for the sake of simplicity.

Said cable is rigidly associated at its ends internally to the rear quarter 204; it subsequently affects a first guiding element 213 provided internally to the rear quarter proximate to the stud 207, then the pulley 211, then a second guiding element 214 provided internally to the front quarter 203 and arranged facing the first guiding element 213, then a third guiding element 215 again arranged internally to the front quarter 203 proximate to its upper end 216.

The cable 208 finally affects a tensioning element such as a lever 217.

During the mutual approaching of the quarters there is an automatic takeup of a certain portion of the cable 208 which in any case allows the securing of the quarters.

The fine adjustment and the subsequent tensioning can be performed by using the lever 217 or similar closure devices.

Naturally the cable can also be not rigidly associated with the rear quarter but instead it can affect the region 212 of the heel and/or 210 of the instep of the foot.

FIG. 7 illustrates another embodiment wherein four pairs of rods, indicated by the reference numerals 305*a*, 305*b*, 305*c*, 305d and 306*a*, 306*b*, 306*c*, 306*d*, are articulated to the front quarter 303 and to the rear quarter 304 and are mutually articulated to form two diamonds, one for each side of the boot.

Each of the diamonds has two opposite vertices, one articulated to the front quarter 303 and the other to the rear quarter 304.

Pulleys 311*a*, 311*b*, 311*c* and 311*d*, are associated with the other two vertices.

The boot comprises a first cable 308*a* which is guided at the pulleys 311*a* and 311*b* and at adapted guiding elements to affect the regions 310 and 312 respectively of the instep and of the heel of the foot.

A second cable 308*b* interacts with an element for its tensioning such as a level 317 external to the boot, then it affects a first and a second guiding element, indicated by the reference numerals 313 and 314, internal to the rear quarter 304, and finally the pulleys 311*c* and 311*d* to be then rigidly associated internally to the front quarter 303.

The mutual approach of the quarters thus allows to simultaneously achieve their closure and the optimum securing of the foot inside the boot.

Figure 9:
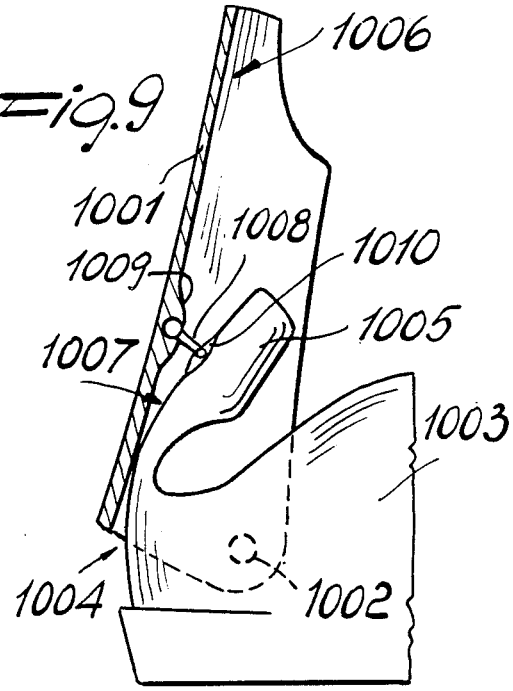
FIG. 9 is a view similar to the preceding one of the same boot with the quarter in closed position.

FIGS. 8,9 partially illustrate a boot according to a further embodiment, comprising a rear quarter 1001 pivoted to a shell 1003 by means of adapted studs 1002.

At the heel region 1004, the shell 1003 has a flap 1005 protruding longitudinally to the boot and elastically articulated to said shell 1003.

An articulation is located between the inner surface 1006 of the rear quarter 1001 and the outer surface 1007 of the flap 1005 and is constituted by a rod 1008 articulated at its ends at adapted lugs 1009 and 1010, protruding respectively from the surfaces 1006 and 1007.

As illustrated in FIGS. 8 and 9, by virtue of the elastic articulation of the flap 1005 to the shell 1003, the rod 1008 imparts to the flap 1005 a movement every time a movement is imparted to the rear quarter 1001.

If therefore the quarters are open, the flap does not occlude the opening for inserting the foot in the boot, while with the quarters closed the flap 1005 optimally secures the heel inside the shell.

Naturally, instead of a single rod 1008, it is possible to have a pair of rods each articulated to one side of the flap and to a pair of lugs protruding from the rear quarter.

Figure 10:
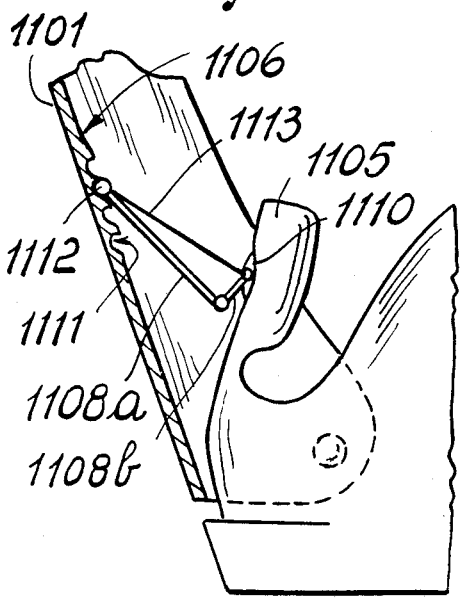
FIG. 10 is a view similar to the preceding ones of a boot according to a sixth embodiment.
Figure 11:
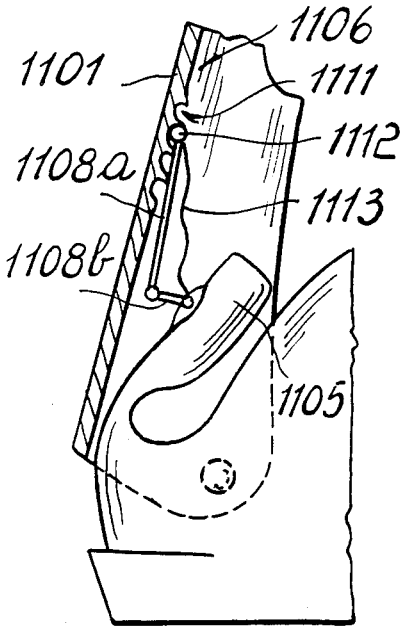
FIG. 11 is a view similar to FIG. 10 of the same boot with the quarter in closed position.

FIGS. 10 and 11 illustrate a further embodiment wherein a plurality of seats 1111, for a complementarily shaped pivot 1112 provided at the end of a first rod 1108*a*, is provided on the inner surface 1106 of the rear quarter 1101.

At its other end said rod is articulated to one end of a second rod 1108*b* which is in turn articulated at its other end at the lug 1110 protruding from the flap 1105.

A traction element 1113, e.g. a cable, is interposed between the pivot 1112 and the end of the second rod 1108*b* articulated to the lug 1110; the element 1113 may also be elastically deformable.

The function of element 1113 is the following: in opening the quarters, the cable 1113 moves back the flap 1105, which is not directly moved by the rods 1108*a* and 1108*b* since they are mutually articulated and would require an excessive rotation of the rear quarter 1101 to move back the flap sufficiently.

In this case instead, when the quarters approach each other, the first rod 1108*a* arranges itself approximately parallel to the quarter 1101, the second rod 1108*b* transmitting the rotation imparted by said quarter to the flap 1105.

During this step the cable 1113 slackens, as the interspace between the pivot 1112 and the end of the second rod 1108*b*, articulated to the lug 1110, decreases.

Figure 12:
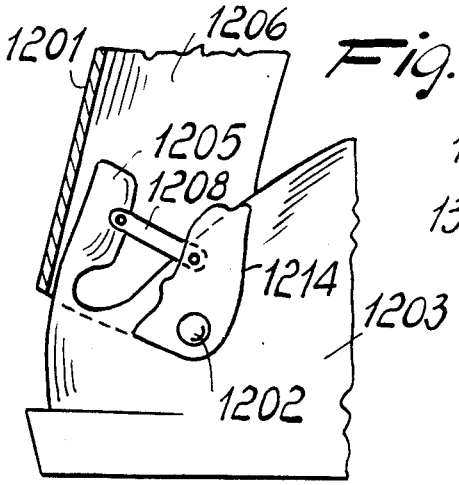
FIG. 12 is a view similar to the preceding ones of a boot according to a seventh embodiment.

FIG. 12 illustrates another embodiment wherein a rod 1208 is freely pivoted to both sides of said flap 1205 and is pivoted at its free end laterally to the inner surface 1206 of the rear quarter 1201.

Advantageously, the pivoting point of said rod to the rear quarter is adjacent to the front perimetral edge 1214 of the quarter 1201 in a region slightly overlying the stud 1202 for pivoting to the shell 1203.

Therefore a rotation imparted to the quarter 1201 corresponds to a rotation of the flap 1205 in the same direction.

Figure 13:
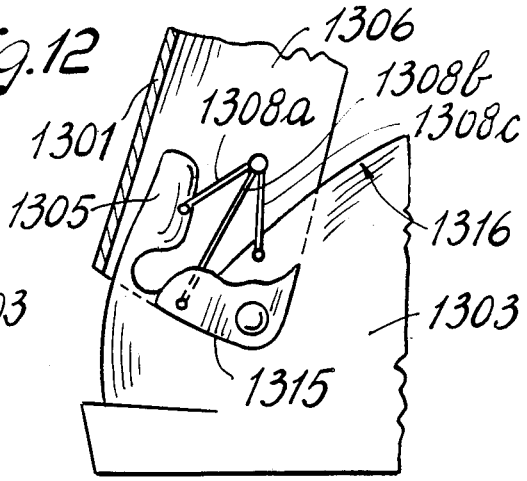
FIGS. 13 and 14 are views, similar to the preceding ones, of a boot according to an eighth embodiment, respectively with the quarter in closed and open positions.
Figure 14:
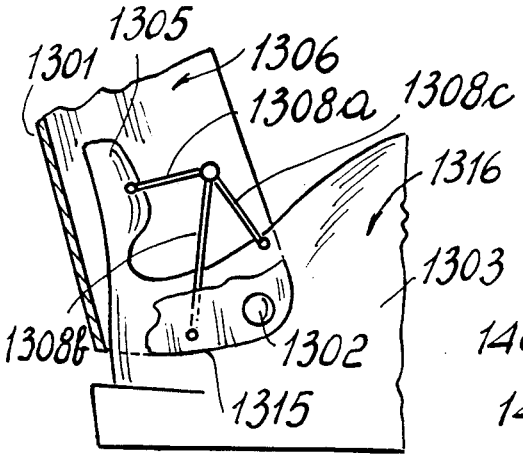

FIGS. 13 and 14 illustrate a further embodiment in which an articulation means is provided at each side of said shell 1303 interposed between the latter and the rear quarter 1301 which embraces said shell.

Each of said articulation means is constituted by a first, by a second and by a third rod, respectively indicated by the reference numerals 1308*a*, 1308*b* and 1308*c*.

All said rods, having appropriate lengths, are articulated to one another at one end and are, at the other end, respectively articulated laterally to the flap 1305, at the inner lateral surface 1306 of the rear quarter 1301 proximate to its lower lateral perimetral edge 1315, and at the outer surface 1316 of the shell 1303 in a region preferably overlying the stud 1302.

Also in this case a rotation imparted to the rear quarter 1301 corresponds to a rotation in the same direction imparted to the flap 1305, which can be angularly diversified depending on the relative lengths of the various rods.

Figure 16:
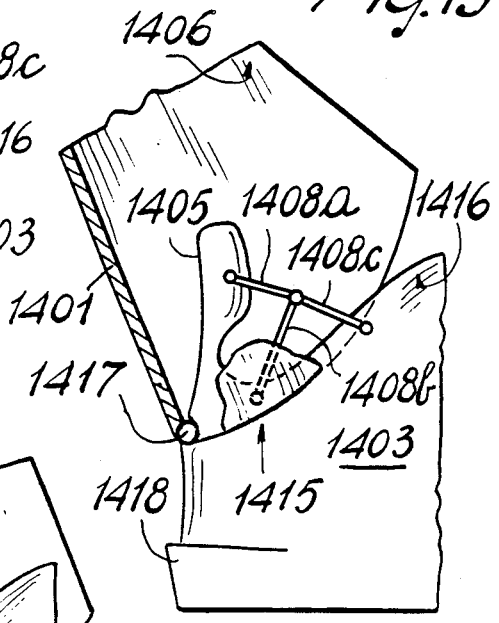
FIGS. 15 and 16 are views, similar to the preceding ones, of a boot according to a further embodiment respectively with the quarter in closed and open positions.
Figure 15:
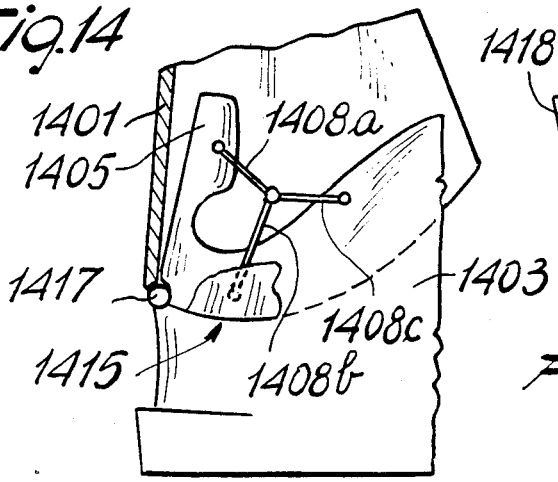

FIGS. 15 and 16 illustrate a further embodiment wherein the reference numeral 1401 indicates a rear quarter of a ski boot pivoted rearwardly to the shell 1403 at an adapted pivot 1417 arranged transversely to said quarter 1401 in a region overlying the region of the heel 1418.

Also in this case the articulation means is constituted by a first, by a second and by a third rod, respectively indicated by the numerals 1408*a*, 1408*b* and 1408*c*.

Said rods are mutually articulated at a same end, and are respectively articulated at the opposite end laterally to the flap 1405, at the inner surface 1406 of the rear quarter 1401 adjacent to the lower lateral perimetral edge 1415 thereof, and at the outer lateral surface 1416 of the shell 1403.

Similarly to the preceding embodiment, the rotation imparted to the rear quarter 1401 imposes, due to the particular coupling of the rods, a rotation to the flap 1405.

The dimensions of the rods naturally affect the degree of rotation which can be imparted to the latter with respect to the one imparted to the rear quarter 1401.

Naturally the adjustment of the degree of opening and/or closure of the flap can be obtained either by varying the length of at least one rod or by using a variable-length rod or by varying the position of at least one articulation point.

It has thus been observed that the invention achieves the intended aim and objects, a boot having been provided with a quarter opening system which is extremely functional and compact and allows an easy introduction of the foot in particular because the flap does not obstruct the opening. The movement which can be imparted to the flap, during the quarter closure step, furthermore allows to achieve the optimum and rapid securing of the heel.

Naturally the invention thus conceived is susceptible to numerous modifications and variations, all within the scope of the same inventive concept.

Naturally the materials and the dimensions of the individual components of the boot may also be the most pertinent according to the requirements of the state of the art.

We claim:

1. Ski boot comprising a shell, a rear quarter and a front quarter, at least said rear quarter being pivoted to said shell, said rear quarter being furthermore articulated to an element of said boot by means of rigid articulation means, wherein said rigid articulation means comprise two pairs of rod-like elements, each of said two pairs of rod-like elements interacting with at least one traction element acting on at least one foot presser.

2. Ski boot, according to claim 1, wherein said two pairs of rod-like elements, arranged mutually facing, comprise two pairs of rods articulated, at their free ends, at the inner lateral surfaces of said front quarter and said rear quarter.

3. Ski boot according to claim 1, wherein said two pairs of rod-like elements, arranged mutually facing, comprise two pairs of rods having free ends, said rods being articulated, at said free ends, at inner lateral surfaces of said rear quarter and at an outer lateral surface of said shell.

4. Ski boot, according to claim 1, wherein the end of a traction element, constituted by a cable guided to affect a presser located at the foot of the skier, is associated at the point of articulation between each of said two pairs of rod-like elements.

5. Ski boot, according to claim 1, wherein a pulley on which a traction element constituted by a cable is guided is rotatably interposed at the point of articulation between each of said pairs of rods, said cable having a loop-like configuration acting on at least one foot presser.

6. Ski boot, according to claim 1, wherein a pulley on which a traction element constituted by a cable is guided, is rotatably interposed at a point of articulation between each of said pairs of rods, said cable having a loop-like configuration acting on at least one foot presser and having free ends rigidly associated laterally and internally with said rear quarter, in a region adjacent to a heel region thereof, said cable, in its path, being symmetrical with respect to a middle plane longitudinal to said front quarter and rear quarter, affecting a first guiding element arranged internally to said rear quarter proximate to the stud for pivoting to said front quarter, then said pulley, subsequently a second guiding element, arranged internally to said front quarter proximate to said pivoting stud, then a third guiding element arranged internally to said front quarter proximate to its upper end, and finally a tensioning element articulated to said rear quarter.

7. Ski boot, according to claim 1, wherein to said front quarter and rear quarter there are articulated four pairs of rods, mutually articulated in pairs, to define a diamond-shaped configuration, and wherein said four pairs of rods have two mutually opposite vertices articulated to said inner lateral surfaces of said front quarter and rear quarter, pulleys being associated at the other two vertices.

8. Ski boot, according to claim 7, wherein said four pairs of rods have two mutually opposite vertices articulated to said inner lateral surfaces of said front quarter and said rear quarter, pulleys being associated at the other two vertices, and furthermore comprising a first cable, having a loop-like configuration, which is guided at said pulleys, arranged at the vertex of the diamond directed towards the upper end of said front quarter and said rear quarter, and then at adapted guiding elements to affect the foot instep and heel regions.

9. Ski boot, according to claim 7, wherein said four pair of rods have two mutually opposite vertices articulated to said inner lateral surfaces of said front quarter and said rear quarter, pulleys being associated at the other two vertices, and furthermore comprising a second cable which interacts with an element for its tensioning, such as a lever external to the boot, subsequently affecting a first and a second guiding element internal to said rear quarter, and finally affecting said pulleys arranged at the vertex of the diamond oriented towards said pivoting stud to be then rigidly coupled internally to said front quarter.

10. Ski boot, according to claim 1, comprising a flap at the region of the heel of the foot, said rear quarter being articulated to said flap by means of said rigid articulation means.

11. Ski boot, according to claim 10, wherein said flap is elastically articulated to said shell and protrudes substantially perpendicular to the sole, between the inner surface of said rear quarter and the outer surface of said flap there being said articulation means comprising at least one rod articulated at its ends at lugs protruding respectively from said inner surface and said outer surface.

12. Ski boot, according to claim 10, wherein said flap protrudes rearwardly to an inner shoe internal to said boot.

13. Ski boot, according to claim 10, wherein said flap rotates rigidly with said rear quarter.

14. Ski boot, according to claim 10, wherein said articulation means comprise a pair of rods, each articulated to one side of said flap and to a pair of lugs protruding laterally to said rear quarter.

15. Ski boot, according to claim 10, wherein on the inner surface of said rear quarter a plurality of seats is provided for a complementarily shaped pivot provided at the end of a first rod articulated at its other end to the corresponding one of a second rod in turn articulated at its other end at a lug protruding from said flap.

16. Ski boot, according to claim 10, wherein on the inner surface of said rear quarter a plurality of seats is provided for a complementarily shaped pivot provided at the end of a first rod articulated at its other end to the corresponding one of a second rod in turn articulated at its other end at a lug protruding from said flap, between said pivot and the end of said second rod articulated to said lug there being interposed a traction element constituted by a cable.

17. Ski boot, according to claim 10, wherein at both sides a rod, pivoted laterally to the inner surface of said rear quarter at its free end, is freely pivoted to said flap, the pivoting point of said rod to said rear quarter being adjacent to the front perimetral edge of said quarter in a region slightly overlying the pivoting point of said rear quarter to said shell.

18. Ski boot, according to claim 10, wherein said rear quarter is pivoted rearwardly to said shell at an adapted pivot arranged transversely to said rear quarter at a region overlying the heel region, said articulation means comprising a first, a second and a third rod, said rods being mutually articulated at a same end, said rods being respectively articulated, at the other end, the first one laterally to said flap, the second one at the inner surface of said rear quarter adjacent to the lower lateral perimetral edge thereof and the third one at the outer lateral surface of said shell.

19. Ski boot comprising a shell, a rear quarter and a front quarter, at least said rear quarter being pivoted to said shell, said rear quarter being furthermore articulated to an element of said boot by means of rigid articulation means, wherein said rigid articulation means comprise at least first connection means and second connection means, said first connection means and said second connection means being articulated to each other to define at least one point of articulation and interacting with at least one traction element, said first connection means having at least one portion thereof articulated to said rear quarter, said second connection means having at least one portion thereof articulated to said element.

20. Ski boot, according to claim 19, wherein said first connection means comprise at least one first pair of rod-like elements, and wherein said second connection means comprise at least one second pair of rod-like elements, said first pair and said second pair of rod-like elements interacting with a means for connecting said front quarter and said rear quarter.

21. Ski boot, according to claim 20, wherein said first pair and said second pair of rod-like elements are arranged mutually facing, and have free ends, said free ends being articulated at inner lateral surfaces of said front quarter and said rear quarter.

22. Ski boot, according to claim 20, wherein said first pair and said second pair of rod-like elements are arranged mutually facing, and have free ends, said free ends being articulated at inner lateral surfaces of said rear quarter and at an outer lateral surface of said shell.

23. Ski boot, according to claim 19, wherein the end of said traction element, constituted by a cable guided to affect a presser located at the foot of the skier, is associated at said point of articulation between said first connection means and said second connection means.

24. Ski boot, according to claim 19, wherein a pulley on which said traction element constituted by a cable is guided is rotatably interposed at said point of articulation between said first connection means and said second connection means, said cable having a loop-like configuration acting on at least one foot presser.

25. Ski boot, according to claim 19, wherein a pulley on which said traction element constituted by a cable is guided, is rotatably interposed at the point of articulation between said first connection means and said second connection means, said cable having a loop-like configuration acting on at least one foot presser and having its free ends rigidly associated laterally and internally to said rear quarter in a region adjacent to a heel region thereof, said cable, in its path, symmetrical with respect to a longitudinal middle plane of said front quarter and rear quarter, affecting a first guiding element arranged internally to said rear quarter proximate to a stud for pivoting to said front quarter, then a pulley, subsequently a second guiding element, arranged internally to said front quarter proximate to said pivoting stud, then a third guiding element arranged internally to said front quarter proximate to its upper end, and finally a tensioning element articulated to said rear quarter.

26. Ski boot, according to claim 19, wherein said first connection means comprise at least first and second pairs of rods and wherein said second connection means comprise at least third and fourth pairs of rods, said first and third pairs of rods being mutually articulated to define a first diamond-shaped configuration, said second and fourth pairs of rods being mutually articulated to define a second diamond-shaped configuration.

27. Ski boot, according to claim 26, wherein said pairs of rods define at least two mutually opposite vertices articulated to inner lateral surfaces of said front quarter and said rear quarter, and at least two other vertices each having associated therewith, at least one pulley.

28. Ski boot, according to claim 26, wherein said pairs of rods define at least two mutually opposite vertices articulated to inner lateral surfaces of said front quarter and said rear quarter, and at least two other vertices having pulleys associated therewith, said at least one traction element comprising a first cable, having a loop-like configuration, which is guided at said pulleys, arranged at the vertex of the diamond-like configuration directed towards an upper end of said front quarter and said rear quarter, and then at guiding elements to affect the foot instep and heel regions.

29. Ski boot, according to claim 26, wherein said pairs of rods define at least two mutually opposite vertices articulated to inner lateral surfaces of said front quarter and said rear quarter, and at least two other vertices having pulleys associated therewith, said at least one traction element further comprising a second cable interacting with a cable tensioning element, and subsequently affecting a first and a second guiding element located internally to said rear quarter, and finally affecting said pulleys arranged at said other vertices, to be then rigidly coupled internally to said front quarter, said other vertices each being oriented towards a pivoting stud.

30. Ski boot comprising a shell, a rear quarter and a front quarter, at least said rear quarter being pivoted to said shell, said rear quarter being furthermore articulated to an element of said boot by means of rigid articulation means, said element comprising at least one flap, said flap being articulated to said shell and located at a heel region defined within said ski boot wherein said flap is elastically articulated to said shell and protrudes substantially perpendicular to the sole, said rigid articulation means being located between an inner surface of said rear quarter and an outer surface of said flap and comprising at least one rod-like element.

31. Ski boot comprising a shell, a rear quarter and a front quarter, at least said rear quarter being pivoted to said shell, said rear quarter being furthermore articulated to an element of said boot by means of rigid articulation means, said element comprising at least one flap, said flap being articulated to said shell and located at a heel region defined within said ski boot, wherein said flap is elastically articulated to said shell and protrudes substantially perpendicular to the sole, said rigid articulation means being located between an inner surface of said rear quarter and an outer surface of said flap and comprising at least one rod-like element, said rod-like element having at least one end and at least one other end, said ski boot further comprising at least one lug and at least one other lug, said one lug protruding from said inner surface of said rear quarter, said other lug protruding from said outer surface of said flap, said one end of said rod-like element being articulated to said one lug, said other end of said rod-like element being articulated to said other lug.

32. Ski boot, according to claim 31, wherein said articulation means comprise at least one pair of rods, and wherein said ski boot further comprises at least one pair of lugs protruding from said rear quarter, each rod in said at least one pair of rods being articulated to at least one side of said flap and to at least one lug in said pair of lugs.

33. Ski boot, according to claim 31, wherein said rear quarter defines an inner surface, wherein said flap has protruding therefrom at least one lug, and wherein said inner surface has defined thereon a plurality of seats, said articulation means comprising at least one first rod having at least one end and at least one other end, and at least one second rod having at least one rod end and at least one other rod end, said one end of said first rod having associated therewith at least one pivot, said pivot being selectively locatable in at least one seat among said plurality of seats, said other end of said first rod being articulated to said one rod end of said second rod, said other rod end being articulated to said lug.

34. Ski boot, according to claim 30, wherein between said pivot and said other rod end end of said second rod articulated to said lug there is interposed at least one traction element, said traction element being constituted by at least one cable.

35. Ski boot, according to claim 30, wherein said rear quarter has at least one side and at least one other side, and wherein said articulation element comprises at least one rod located at each said side of said rear quarter, each said rod having at least one end and at least one other end, said one end being pivotally connected to the inner surface of said rear quarter and defining a pivot point, said other end being freely pivotally connected to said flap, said pivot point being located adjacent a front perimetral edge of said rear quarter in a region slightly overlying a pivoting point of said rear quarter to said shell.

36. Ski boot, according to claim 30, wherein said articulation means are arranged at each side of said shell and interposed between said shell and said rear quarter, said articulation means comprising a first rod having at least one first rod end and at least one other first rod end, a second rod having at least one second rod end and at least one other second rod end, and a third rod having at least one third rod end and at least one other third rod end, said one first rod end and said one second rod end and said one third rod end being mutually articulated, said other first rod end being articulated laterally to said flap, said other second rod end being articulated to a lateral inner surface of said rear quarter, proximate to a lower lateral perimetral edge thereof, said other third rod end being articulated to an outer lateral surface of said shell in a region overlying a point of pivotal connection of said rear quarter to said shell.

37. Ski boot, according to claim 28, wherein said rear quarter is pivoted rearwardly to said shell at a pivot, said pivot being arranged transversely to said rear quarter at a region overlying a heel region of said ski boot, said articulation means comprising a first rod having at least one first rod end and at least one other first rod end, a second rod having at least one second rod end and at least one other second rod end, and a third rod having at least one third rod end and at least one other third rod end, said one first rod end and said one second rod end and said one third rod end being mutually articulated, said other first rod end being articulated laterally to said flap, said other second rod end being articulated to a lateral inner surface of said rear quarter, proximate to a lower lateral perimetral edge thereof, said other third rod end being articulated to an outer lateral surface of said shell.

* * * * *